US005486890A

United States Patent [19]

Mogi

[11] Patent Number: 5,486,890

[45] Date of Patent: Jan. 23, 1996

[54] SYSTEM FOR CONTROLLING THE TEMPERATURES OF PROCESSING SOLUTIONS IN PHOTOSENSITIVE MATERIAL PROCESSORS

[75] Inventor: Fumio Mogi, Kaisei, Japan

[73] Assignee: Fuji Photo Film Co., Ltd., Kanagawa, Japan

[21] Appl. No.: 278,221

[22] Filed: Jul. 21, 1994

[30] Foreign Application Priority Data

Jul. 26, 1993 [JP] Japan ..... 5-183687

[51] Int. Cl.[6] ..... G03D 13/00

[52] U.S. Cl. ..... 354/299

[58] Field of Search ..... 354/298, 299, 354/319–324; 134/64 P, 64 R, 122 P, 122 R; 219/485

[56] References Cited

U.S. PATENT DOCUMENTS

| | | | |
|---|---|---|---|
| 4,451,132 | 5/1984 | Kishimoto | 354/324 |
| 4,755,843 | 7/1988 | Foley | 354/299 |
| 4,813,440 | 3/1989 | Johnson et al. | 134/122 R |
| 4,888,608 | 12/1989 | Kümmerl | 354/299 |
| 5,148,206 | 9/1992 | Shidara | 354/298 |
| 5,168,296 | 12/1992 | Nakamura et al. | 354/320 |
| 5,235,371 | 8/1993 | Samuels | 354/299 |
| 5,313,241 | 5/1994 | Seim | 354/298 |

*Primary Examiner*—D. Rutledge

*Attorney, Agent, or Firm*—Sughrue, Mion, Zinn, Macpeak & Seas; Richard C. Turner; Peter A. McKenna

[57] ABSTRACT

The present invention provides a system for controlling the temperatures of processing solutions in a photosensitive material processor, which enables the temperatures of processing solutions to be controlled with a smaller power source capacity yet with high efficiency. In a photosensitive material processor including a plurality of processing tanks 12 to 19 for processing a photosensitive material F and a drier 30, at least one processing tank is provided with a plurality of independently controllable electric heaters N1-1 to 1-3 capable of heating the processing solution therein. Depending on the heat capacity needed for each processing tank, power supply to the heater for the processing tank under low load is stopped when the power consumption of the processor proper is increased, thereby achieving an efficient distribution of power and, hence, enabling power source equipment of very small capacity to be used.

8 Claims, 8 Drawing Sheets

SYSTEM FOR CONTROLLING THE TEMPERATURES OF PROCESSING SOLUTIONS IN PHOTOSENSITIVE MATERIAL PROCESSORS

BACKGROUND OF THE INVENTION

The present invention relates to a photosensitive material processor, and more particularly to a system for controlling the temperature of processing solutions used therein.

In an automatic processor that is one of photosensitive material processors, a belt form of photosensitive material such as photographic negative film or paper is delivered on delivery rollers, while it is successively immersed and processed in developing, fixing and washing tanks. The thus processed photosensitive material is dried by a drier, and then ejected out of the processor.

In such a photosensitive material processor with a plurality of built-in processing tanks, it is required to keep developing, fixing and washing solutions at a constant temperature, and provided to this end are a plurality of heaters in operative association with the individual processing tanks. One or more heaters are provided for each processing tank.

An additional heater is needed for a drier for drying the processed photosensitive material.

In the case of a conventional photosensitive material processor including a plurality of heaters, there is a possibility that all the heaters including one for the drier may be simultaneously put on, and so there is needed a large electric capacity which has to be supplied by means of large power source equipment.

SUMMARY OF THE INVENTION

In view of the problem mentioned above in connection with the prior art, a primary object of the invention is to provide a system for controlling the temperatures of processing solutions in a photosensitive material processor, which enables efficient temperature control to be achieved with a smaller power source capacity.

According to the present invention, the above object is achieved by the provision of a system for controlling the temperatures of processing solutions in a photosensitive material processor including a plurality of tanks for processing photosensitive material and a drier, characterized in that at least one processing tank is provided with a plurality of independently controllable electric heaters capable of heating the processing solution therein.

Preferably, one or more electric heaters of said plurality of electric heaters may be supplied with power only when the processor is actuated for heating purposes, and may be shut down while the temperature of the processing solution is being controlled or while an electric heater for the drier is being supplied with power.

According to another aspect of the invention, there is provided a system for controlling the temperatures of processing solutions in a photosensitive material processor including a plurality of tanks for processing photosensitive material and a drier, characterized in that at least one processing tank is designed to be replenished with an overflow from an other processing tank, and is provided with an electric heater capable of heating the processing solution therein, said electric heater being designed to be shut down while an electric heater for said drier is being supplied with power.

According to still another aspect of the invention, there is provided a system for controlling the temperatures of processing solutions in a photosensitive material processor including a plurality of tanks for processing photosensitive material and a drier, characterized in that at least one processing tank is designed to be replenished with an overflow from an other processing tank, and is provided with a plurality of electric heaters capable of heating the processing solution therein, one or more electric heaters of said plurality of electric heaters being supplied with power only when said processor is actuated to heat the processing solution, and being shut down while the temperature of the processing solution is being controlled.

In this case, one or more electric heaters of said plurality of electric heaters is or are shut down while an electric heater for said drier is being supplied with power.

According to a further aspect of the invention, there is provided a system for controlling the temperatures of processing solutions in a photosensitive material processor including a plurality of tanks for processing photosensitive material and a drier, characterized in that at least one processing tanks is provided with a plurality of circulating paths through which the processing solution therein is circulated, each of said circulating paths being provided with an electric heater for heating the processing solution, at least two circulating paths being integrally cast into a good heat conductor at positions of the associated heaters to form a heating unit, and said heating unit being provided with a cooling means.

According to still further aspect of the invention, there is a system for controlling the temperatures of processing solutions in a photosensitive material processor including a plurality of tanks for processing photosensitive material and a drier, characterized in that at least one of the processing tanks is provided with a plurality of circulating paths through which the processing solution therein is circulated, said circulating paths, together with associated electric heaters, being separately cast into at least two good heat conductors, said good heat conductors being attached to a common metal bracket with ventilation passages therebetween, thereby forming a heating unit, and said heating unit being provided with a cooling means.

According to the present invention wherein a plurality of independently controllable electric heaters are provided, depending on the heat capacity needed for each processing tank, power supply to the heater for the processing tank under low load is stopped when the overall power consumption of the processor proper becomes high, thereby achieving an efficient distribution of power and, hence, enabling power source equipment of very small capacity to be used. This then makes it possible not only to achieve a size reduction in the processor proper, but also to enable use of electric equipment of small capacity.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Some embodiments of the present system for controlling the temperatures of processing solutions in a photosensitive material processor will now be explained at great length.

Figure 1:
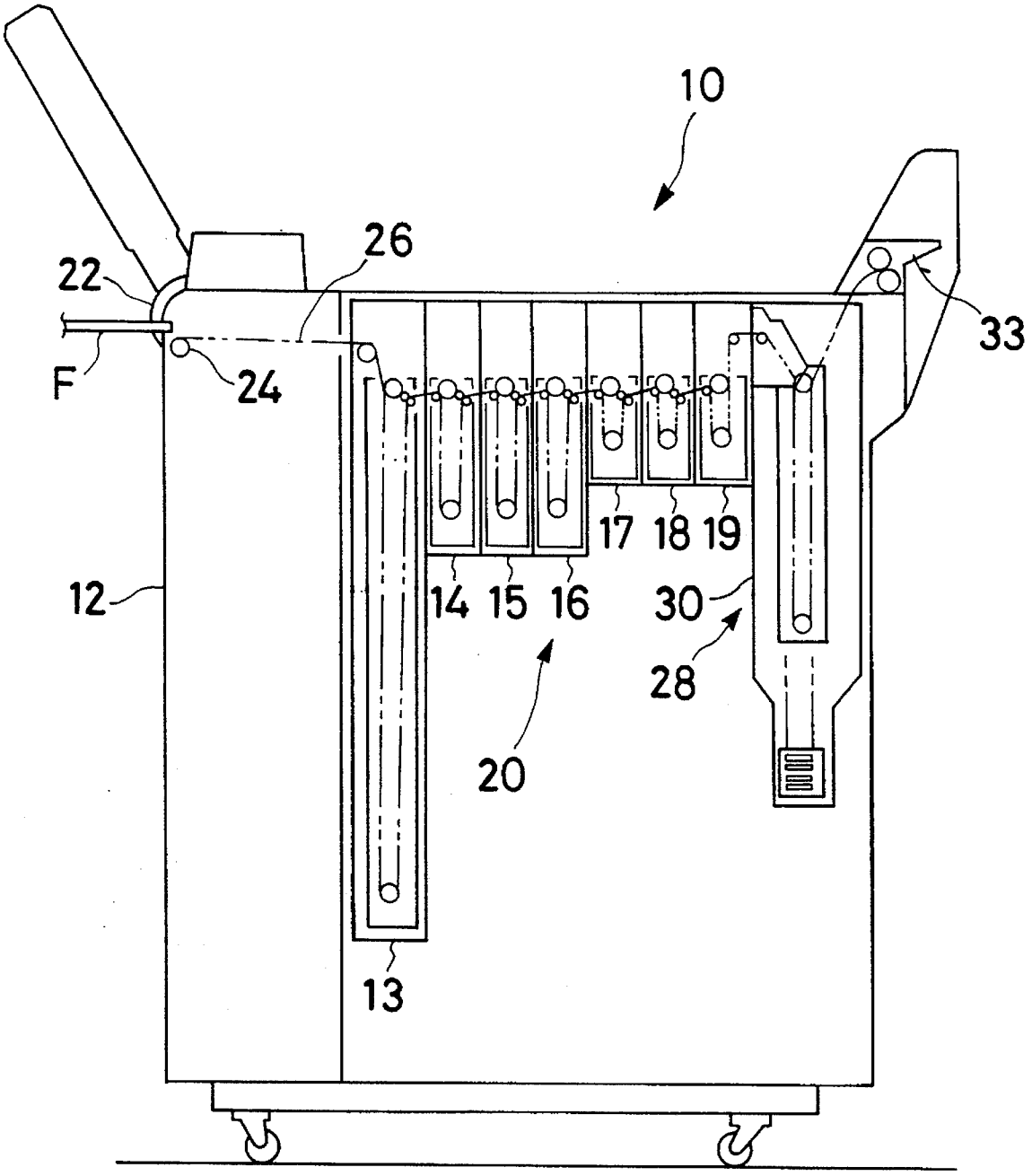
FIG. 1 is a schematic of the general construction of one embodiment of the automatic processor to which the invention is applied.

FIG. 1 is a schematic of the general structure of an automatic processor 10 for negative film that is used as the photosensitive material processor. Within a housing 12 of the automatic processor 10, as illustrated, there is provided a processing unit 20 built up of a color developing tank 13, a bleaching tank 14, a bleach-fix tank 15, a fixing tank 16, a washing tank 17, and rinsing tanks 18 and 19. Photosensitive material or negative film F is fed from a film feeding unit 22 into the housing 12 where it is successively delivered by delivery rollers 24 along a delivery path 26 to the processing tanks 13, 14, 15, 16, 17, 18 and 19 for development, bleaching, fixing, washing, and stabilization.

Within the housing 12 a drier 28 is followed by the processor unit 20. The drier 28 includes a drying box 30 located adjacent to the rinsing tank 19, in which box dry air is circulated. The developed and otherwise processed negative film F is dried by this dry air, while it is delivered through the box 30 along a U-shaped path. Then, the dried negative film F is ejected out of the processor through an ejecting unit 33.

Figure 2:
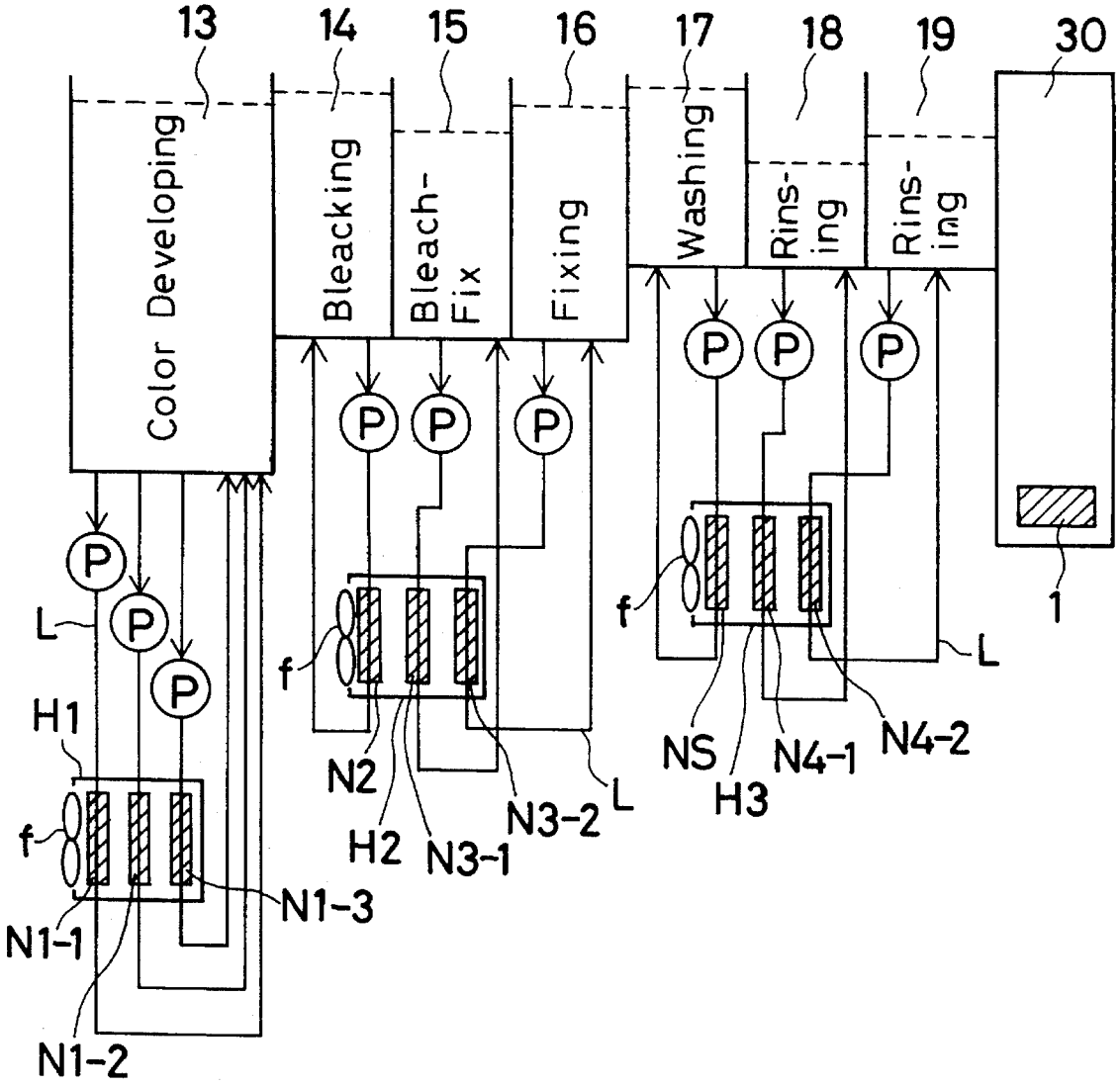
FIG. 2 is a schematic of the processing tanks, drying box, heaters attached to the processing units, etc., of the processor shown in FIG. 1.

Thus, the automatic processor 10 according to this embodiment has seven processing tanks 13 to 19. FIG. 2 is a schematic of the processing tanks 13 to 19, drying box 30, heaters attached to the tanks, etc. Attached to the processing tank 13 are solution-circulating paths L through which solutions are circulated in the directions shown by arrows, and pumps P for circulating purposes. Attached to each of the processing tanks 14 to 19 are a single solution-circulating path L and a similar pump P. These paths L are provided with heaters N2, N3-1, N3-2, NS, N4-1, and N4-2 in parallel configuration, thereby heating the circulating solutions. As already mentioned, the color developing tank 13 is provided with a similar pump P, and three solution-circulating paths L, each being provided with a heater, as shown by N1-1, N1-2, or N1-3. Thus, the processing unit 20 has nine heaters in all. Within the drying box 30 there is one drying heater 1.

Figure 3B:
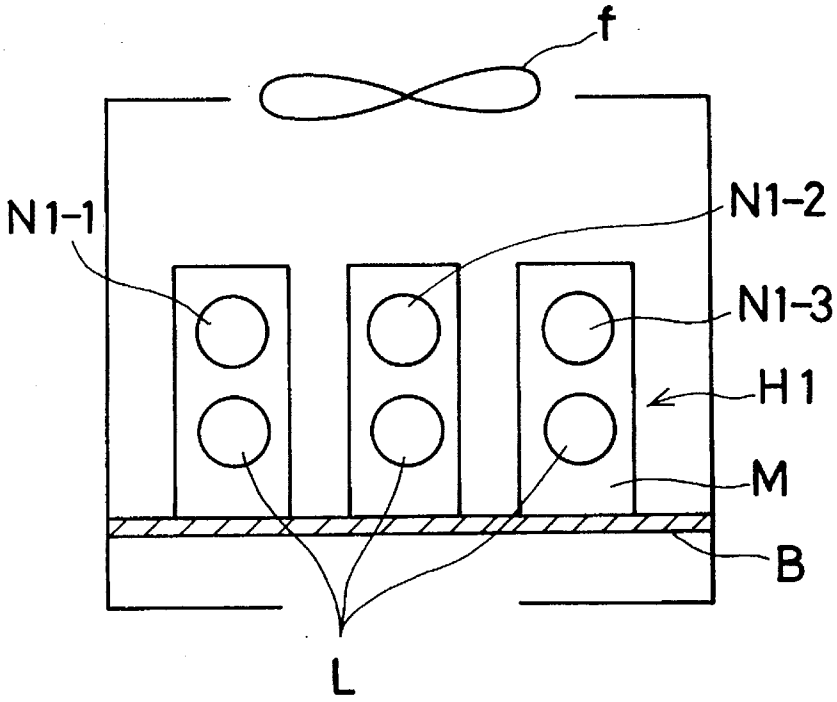
FIGS. 3*a* and 3*b* is sectional views of the heating units according to the invention.
Figure 3A:
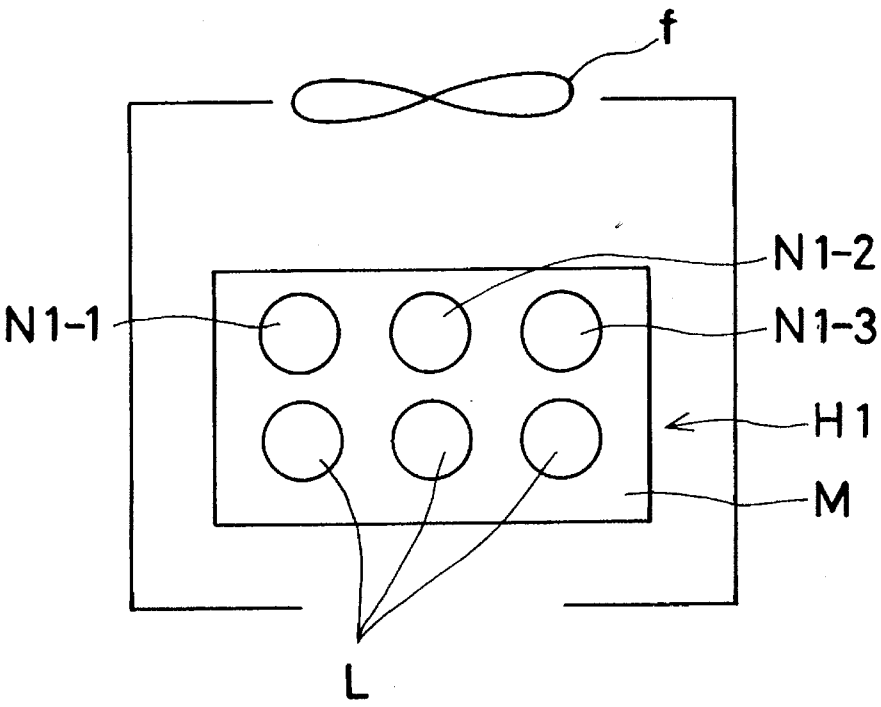

As can be seen from FIG. 3(*a*), the three circulating paths L for the color developing heater 13 are integrally cast into a good heat conductor M such as one formed of aluminum at positions of the heaters N-1, N-2 and N-3, thereby forming a heating unit H1. The heating unit H1 is further provided with a fan f for cooling purposes. Again, the three circulating paths L attached to the bleaching, bleach-fix and fixing tanks 14, 15 and 16 are integrally cast into a good heat conductor at positions of the associated heaters N2, N3-1 and N3-2, thereby forming a heating unit H2. The heating unit H2, too, is further provided with a fan f for cooling purposes. Likewise, the three circulating paths L attached to the washing, rinsing and rinsing tanks 17, 18 and 19 are integrally cast into a good heat conductor at positions of the associated heaters NS, N4-1 and N4-2, thereby forming a heating unit H3. The heating unit H3, too, is further provided with a fan f for cooling purposes.

Alternatively or as shown in FIG. 3(*b*), the heating unit may be constructed by casting the three circulating paths L into separate good heat conductors M at positions of the associated heaters, and attaching these conductors M to a common metal bracket B with ventilation passages between them. Again, this heating unit is provided with a fan f for cooling purposes.

For instance, the processing solutions should be controlled at temperatures of 37.6°±0.15° C. in the color developing tank 13, 38°±3° C. in the bleaching tank 14, 38°±3° C. in the bleach-fix tank 15, 38°±3° C. in the fixing tank 16, 38°±3° C. in the washing tank 17, and 38°±3° C. in both the rinsing tanks 18 and 19.

Now consider the case where all nine heaters have the same electric capacity of 360 W at 240 V. With all the heaters working simultaneously at 240 V, the required total capacity amounts to 360 W×9=3,240 W. In other words, power source equipment of such a large capacity will be needed, even though only the heaters used for processing solutions are taken into account.

In the present invention, power supply to the heater or heaters attached to the processing tank or tanks on which small loads are applied is stopped depending on the heat capacity required for each processing tank (the magnitude of load), when the overall power consumption of the processor is large. In general, it is when power is supplied to the drying heater 1 (FIG. 2), while the processor is being driven for processing film F that some large load is applied on an automatic processor such as one shown at 10 in FIG. 1. The drying heater 1 used for this processor has an electric capacity of 2,400 W; that is, when no reliance is on the system according to the present invention, the required total electric capacity amounts to as high as 5,640 W (3,240 W+2,400 W), even when only the heaters N1-1, N1-2, N1-3, N2, N3-1, N3-2, NS, N4-1 and the drying heater 1 are taken into consideration. In this case, power source equipment of such a large capacity is needed. However, the system according to the present invention makes an efficient distribution of power possible, and so enables power source equipment of a very low electric capacity to be used.

Figure 4:
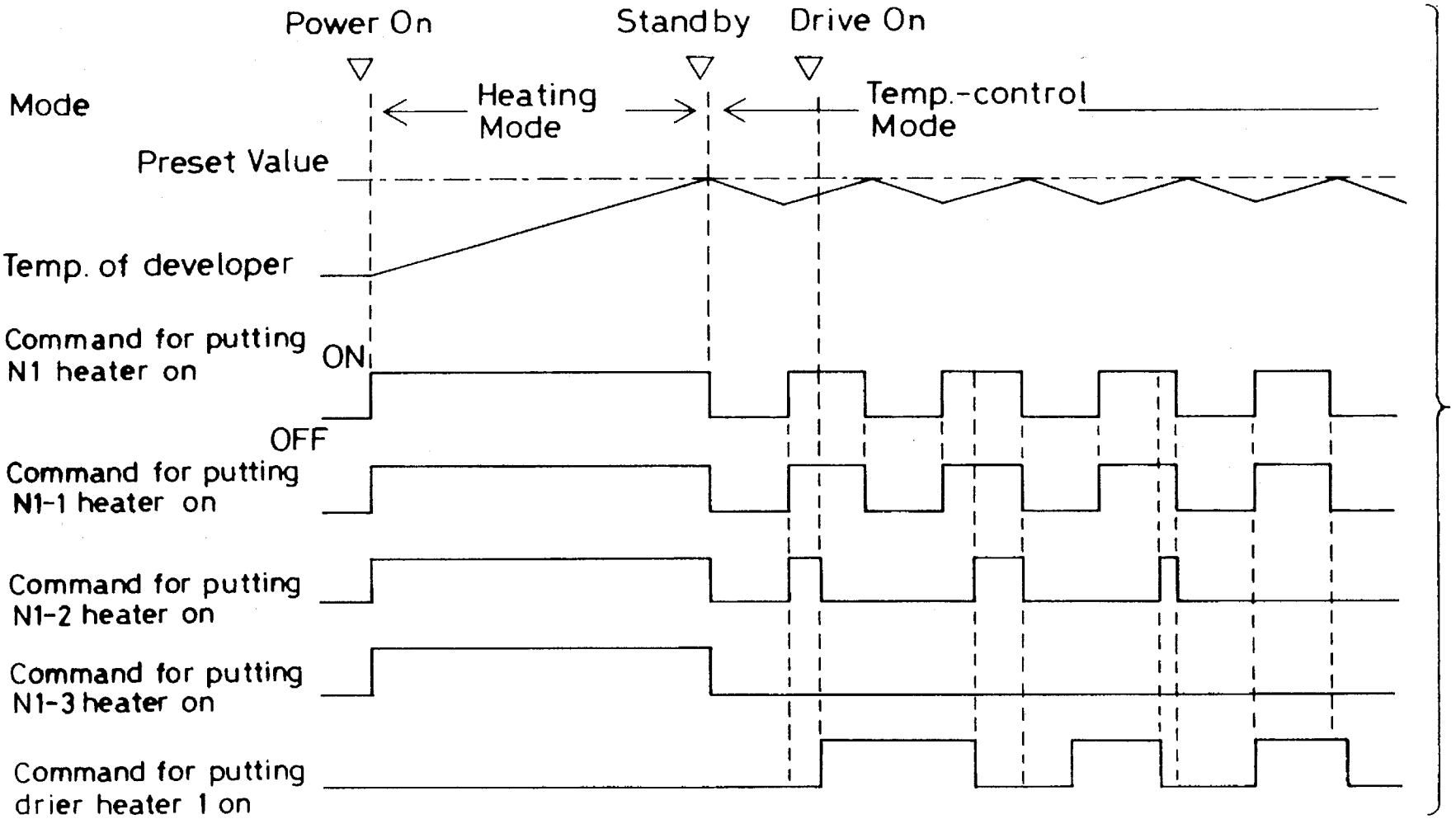
FIG. 4 is a timing chart for control of power supply to the heaters for the developing tank.

The first embodiment of the invention will now be explained with reference to FIG. 4 or a timing chart showing control of power supply to each heater. In this embodiment, unnecessary power for the heaters N1-1, N1-2 and N1-3 attached to the color developing tank 13 is reduced as much as possible, thereby reducing the overall power consumption of the processor 10. For instance, a heater of large capacity is needed for the actuation in the morning of the tank 13 through which the processing solution passes at high flow rates, thereby elevating the temperature of the processing solution. The heater, when it is of small capacity, results in a drop of the heating rate, incurring some considerable inconvenience. A 1,080-W heater is usually needed for the color developing tank 13. According to this embodiment, however, three heater elements, each of 360 W, are provided and separately placed under power control, as shown in FIG. 2. This enables the temperature of the processing solution to be regulated and maintained by the heater elements of small capacity after the temperature rise. More specifically, all three heater elements N1-1, N1-2 and N1-3 are simultaneously supplied with power for elevating the temperature of the processing solution, as shown in FIG. 4. After this, one heater element N1-1 is completely shut down, while the remaining two heater elements N1-2 and N1-3 continue to be operated for temperature control. Moreover, while the drier heater 1 that applied some large load on the processor proper is being supplied with power, another heater element N1-2 is shut down with the last one heater element N1-3 continuing to be operated for temperature control.

Figure 5:
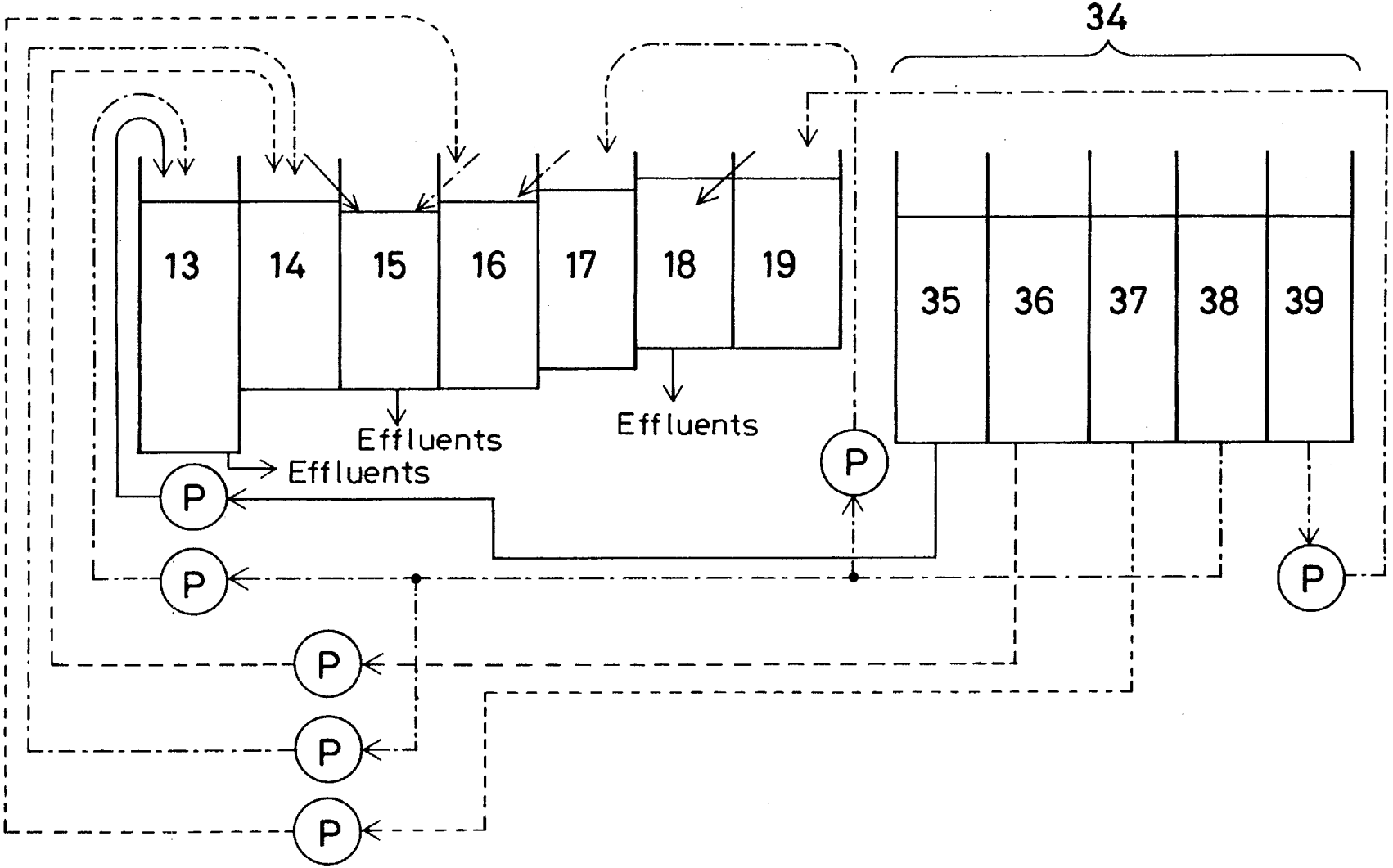
FIG. 5 is a schematic of how the processing units are replenished with processing solutions and effluents from the processing tanks are used or otherwise disposed.

FIG. 5 is a schematic of how the tanks 13–19 shown in FIG. 3 are replenished with fresh solutions and how effluents from them are used or otherwise disposed. In this embodiment, fresh solutions are supplied to the tanks from 5 fresh solution reservoirs 35–39 located in a fresh solution-supplying unit 34 by means of a pump P along paths shown in FIG. 5. Each tank is replenished with a fresh solution in the amount that is determined depending on the throughput of film F detected by a photosensor located at the feed portion. Effluents from tanks 13, 15 and 18 are immediately discharged to an effluent reservoir provided on the outside of the automatic processor 10. As can be seen from FIG. 5, both the bleach-fix tank 15 and rinsing tank 18 are designed to receive no fresh solutions directly from the fresh solution-supplying unit 34; the tank 15 receives overflows from the adjacent bleach-fix tank 14 and fixing tank 16, while the rinsing tank 18 receives an overflow from the downstream rinsing tank 19. The fixing tank 16, on the other hand, is replenished with a fresh solution coming directly from the fresh solution-supplying unit 34 together with an overflow from the washing tank 17.

Figure 6:
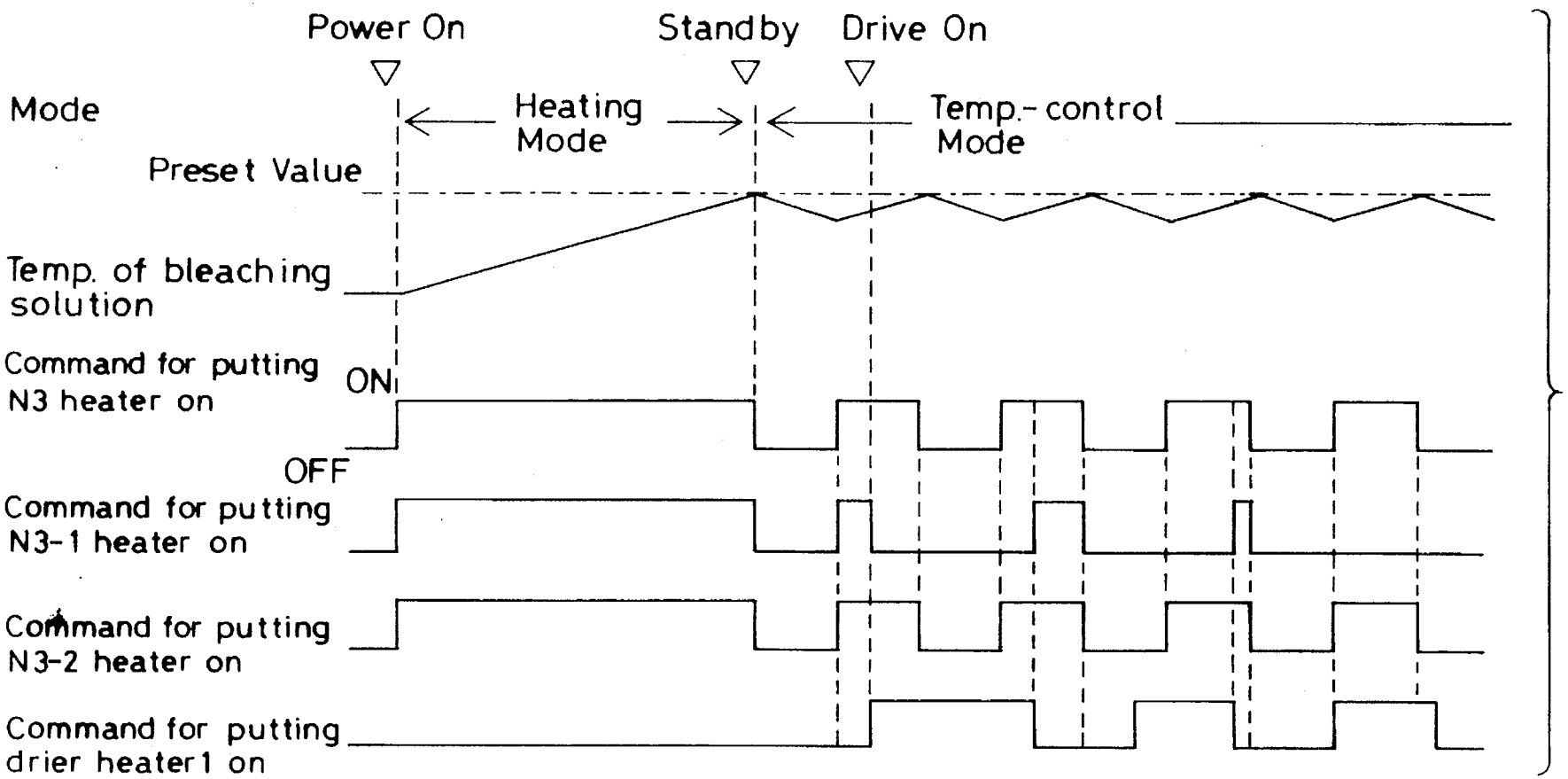
FIG. 6 is a timing chart for control of power supply to the heater for the bleach-fix tank.
Figure 7:
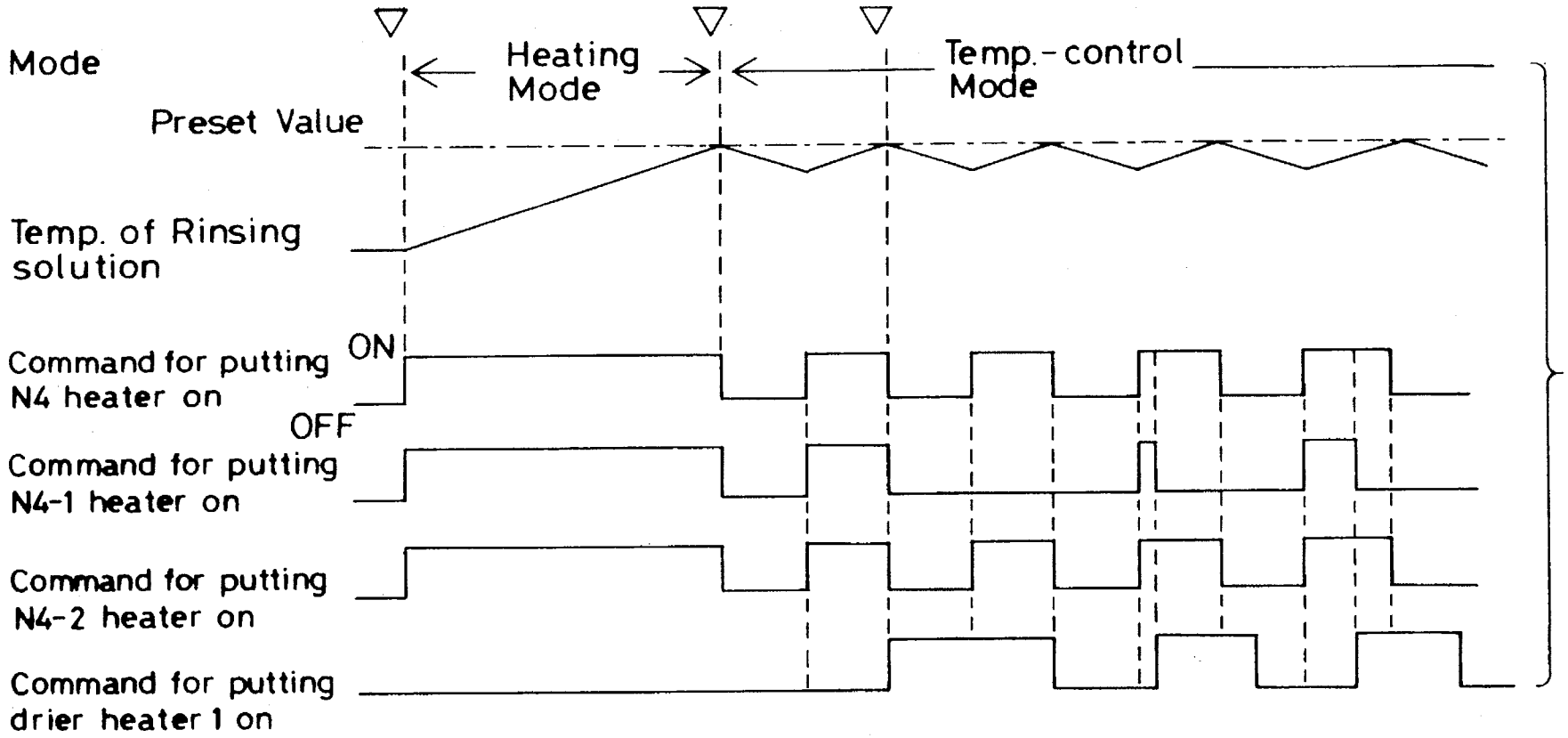
FIG. 7 is a timing chart for control of power supply to the heaters for the rinsing tanks.

The second embodiment of the invention will now be explained with regard to control of power supply to heaters attached to processing tanks which receive overflows from other processing tanks and do not directly receive any solution from the solution reservoirs, as in the case of the bleach-fix tank 15 and rinsing tank 18. FIG. 6 is a timing chart for control of power supply to the heater for the bleach-fix tank 15, and FIG. 7 is a timing chart for control of power supply to the heater for the rinsing tank 18. The quantity of heat needed for controlling the temperature of the processing solutions in the bleach-fix tank 15 and rinsing tank 18 is small, because any cold fresh solution such as one stored in the reservoirs does not enter them; in other words, they receive only temperature-controlled overflows from other tanks. Therefore, such tanks need heater elements of capacity enough to obtain the heating rate required to actuate them in the morning. However, such large capacity is not needed for post-heating temperature control. This will now be explained more illustratively with reference to FIGS. 6 and 7. During heating, a heater N3-1 for the bleach-fix tank 15, together with a heater N3-2 for the fixing tank 16, etc., is supplied with power, as shown in FIG. 6. After heating, however, this heater is operated for temperature control alone, but is shut down while the drying heater 1 (which applies a heavy load on the processor) is in operation. During heating, a heater N4-1 for the rinsing tank 18, together with a heater N4-2 for the rinsing tank 19, etc., is supplied with power, as shown in FIG. 7. After heating, this heater is operated for temperature control alone, but is shut down while the drying heater 1 is in operation. In this embodiment, one heater of 360 W is used for each of the bleach-fix and rinsing tanks 15 and 18. It is here understood that the capacity needed for temperature control is less than 50% of that needed for heating. Therefore, each heater may be made up of two elements of 180 W, one of which may be shut down during temperature control.

By use of the power control system mentioned above, it is thus possible to reduce the load on the processor proper, as set out below.

| Driving Mode (in which film is being processed) | | | | | |
|---|---|---|---|---|---|
| | Heaters for Solutions | | Drying Heater | | Total |
| Prior Art | (360 W × 9) | + | (2,400 W) | = | 5,640 W |
| Present System | (360 W × 5) | + | (2,400 W) | = | 4,200 W |

A 25% power saving was achieved due to the fact that N1-2, N1-3, N3-1 and N4-1 could be shut down during the operation of the processor.

| Standby Mode (in which film is not feed through the processor) | | | |
|---|---|---|---|
| | Heaters for Solutions | | Total |
| Prior Art | (360 W × 9) | = | 3,240 W |
| Present System | (360 W × 8) | = | 2,880 W |

A 12% power saving was achieved due to the fact that N1-3 could be shut down during the actuation of the processor.

Figure 8:
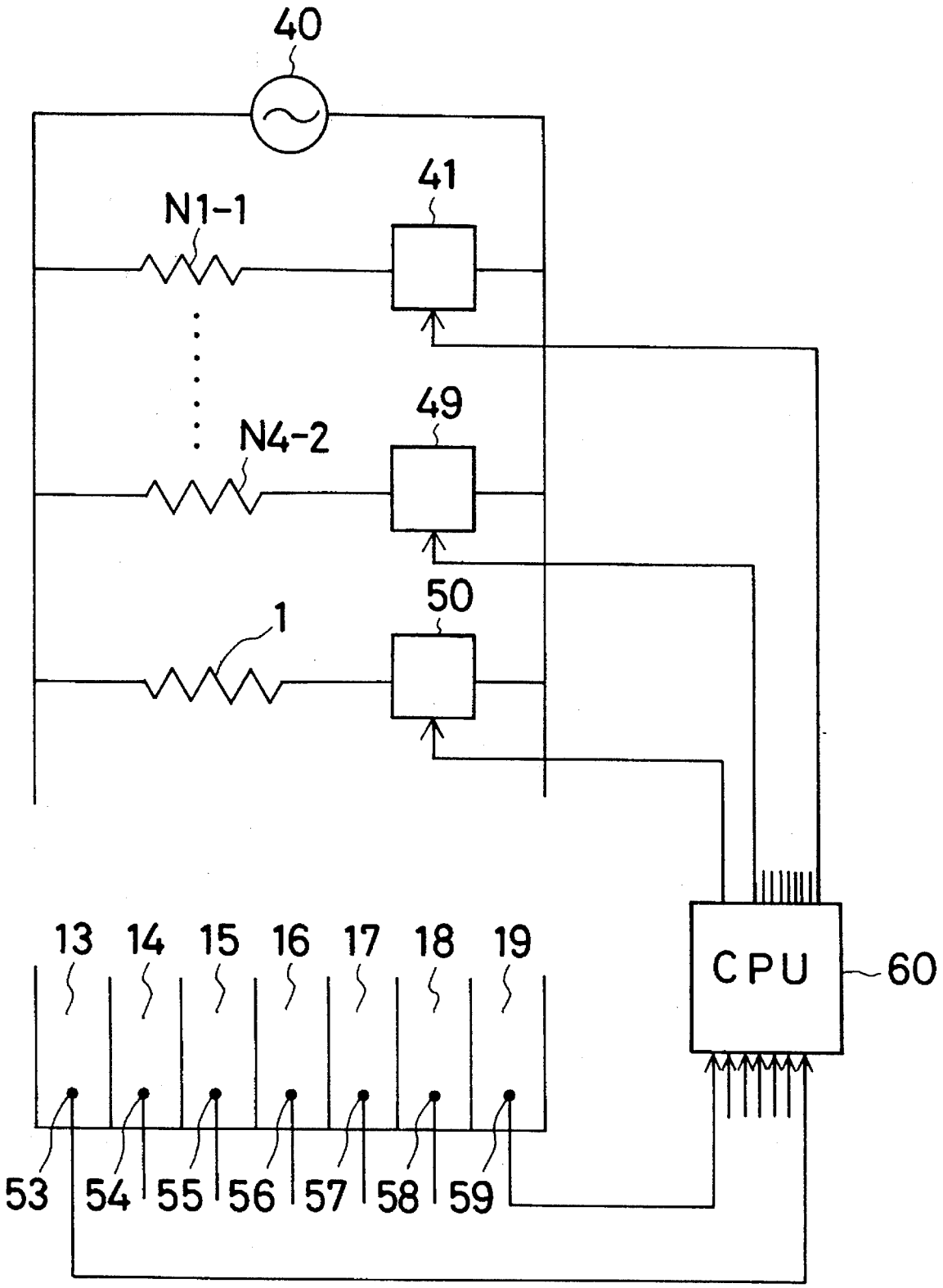
FIG. 8 is a diagram showing one control circuit.

Independent control of the individual power supply timings of a plurality of heaters 1, N1-1, N1-2, N1-3, N2, N3-1, N3-2, NS, N4-1 and N4-2 connected parallel with a single power source may be achieved by such a circuit as shown in FIG. 8. As illustrated, the heaters N1-1, N1-2, N1-3, N2, N3-1, N3-2, NS, N4-1 and N4-2 are connected in parallel with a commercial power source 40 via switching circuits 41 to 50 such as thyristors. Then, a CPU 50 is connected to the switching circuits 41 to 50, so that signals for placing these switching circuits under on-and-off control can be fed thereto. The processing tanks 13 to 19 are provided therein with thermometers 53 to 59 for detecting the temperatures of the processing solutions, and are again connected to the CPU 60, so that detection signals can be fed thereto. With such a control circuit, power supply to each heater is controlled at the timings shown in FIGS. 4, 6 and 7.

As already mentioned in connection with FIG. 3, a plurality of circulating paths for each processing tank are integrally cast into a good heat conductor M at positions of the associated heaters to form heating units H1, H2, and H3. Alternatively, the plurality of circulating paths are cast into separate good heat conductors M at positions of the associated heaters, and the heat conductors M are then attached to a common bracket with ventilation passages between them, thereby forming heating units H1 to H3. Each heating unit is provided with cooling means such as a fan f. Thus, it is possible to achieve an efficient cooling of the processing solution in each processing tank. If required, it is also possible to achieve an efficient cooling of the heater during its shutdown due to the radiating action of the fan. In the case of the heating unit H1 for instance, two heaters N1-1 and N1-2 continue to be operated after heating, while the remaining one N1-3 is not operated at all. If required, however, it is possible to achieve an efficient cooling of all the heaters, because the heating unit H1 is made integral with the heater N1-3, so that the surface area required for cooling can be assured. If the heating unit should be made up of one or two heaters, under-cooling is to occur. In this connection, it is desired that one heating unit may be attached to a set of processing tanks, if the processing solutions are substantially at the same temperatures.

While the inventive system for controlling the temperatures of processing solutions in a photosensitive material processor has been described with reference to the preferable embodiments, it is understood that many changes or modifications may be possible without departing from the purport of the invention.

As can be appreciated from what has been described, according to the present system for controlling the temperatures of processing solutions in a photosensitive material process wherein a plurality of independently controllable electric heaters are provided, it is possible to stop power supply to the heater for a processing tank or tanks under reduced loads depending on the heat capacity needed for each tank, when the power consumption of the processor proper is increased, thereby achieving an efficient distribution of power and enabling power source equipment of very low capacity to be used. For this reason, it is possible not only to reduce the size of the processor but also to enable power source equipment on the user side to be used, if it is of low capacity.

What we claim is:

1. In a photosensitive material processor including a plurality of tanks for processing photosensitive material and a drier, a system for controlling the temperatures of processing solutions in said processor characterized in that at least one processing tank is provided with a plurality of independently controllable electric heaters capable of heating the processing solution therein.

2. A system for controlling the temperatures of processing solutions according to claim 1, characterized in that one or more electric heaters of said plurality of electric heaters is or are supplied with power only when said processor is actuated to initially heat the processing solutions in said processor, and is or are shut down while the temperature of the processing solution is being maintained.

3. A system for controlling the temperatures of processing solutions according to claim 1, characterized in that one or more electric heaters of said plurality of electric heaters is or are shut down while an electric heater for said drier is being supplied with power.

4. In a photosensitive material processor including a plurality of tanks for processing photosensitive material and a drier, a system for controlling the temperatures of processing solutions in said processor characterized in that at least one processing tank is designed to be replenished with an overflow from at least one other processing tank, and is provided with an electric heater capable of heating the processing solution therein, said electric heater being designed to be shut down while an electric heater for said drier is being supplied with power.

5. In a photosensitive material processor including a plurality of tanks for processing photosensitive material and a drier, a system for controlling the temperatures of processing solutions in said processor characterized in that at least one processing tank is designed to be replenished with an overflow from other processing tank, and is provided with a plurality of electric heaters capable of heating the processing solution therein, one or more electric heaters of said plurality of electric heaters being supplied with power only when said processor is actuated to initially heat the processing solutions in said processor, and being shut down while the temperature of the processing solution is being maintained.

6. A system for controlling the temperatures of processing solutions according to claim 5, characterized in that one or more electric heaters of said plurality of electric heaters is or are shut down while an electric heater for said drier is being supplied with power.

7. In a photosensitive material processor including a plurality of tanks for processing photosensitive material and a drier, a system for controlling the temperatures of processing solutions in said processor characterized in that one or more processing tanks is or are provided with a plurality of circulating paths through which the processing solution or solutions therein is or are circulated, each of said circulating paths being provided with an electric heater, at least two circulating paths being integrally cast into a good heat conductor at positions of the associated heaters to form a heating unit, and said heating unit being provided with a cooling means.

8. In a photosensitive material processor including a plurality of tanks for processing photosensitive material and a drier, a system for controlling the temperatures of processing solutions in said processor characterized in that one or more processing tanks is or are provided with a plurality of circulating paths through which the processing solution or solutions therein is or are circulated, said circulating paths, together with associated electric heaters, being separately cast into at least two good heat conductors, said good heat conductors being attached to a common metal bracket with ventilation passages therebetween, thereby forming a heating unit, and said heating unit being provided with a cooling means.

* * * * *